US012610991B2

(12) United States Patent
Waters

(10) Patent No.: US 12,610,991 B2
(45) **Date of Patent: *Apr. 28, 2026**

(54) BREAST SUPPORT GARMENT

(71) Applicant: LULULEMON ATHLETICA CANADA INC., Vancouver (CA)

(72) Inventor: Jessica May Waters, Vancouver (CA)

(73) Assignee: LULULEMON ATHLETICA CANADA INC., Vancouver (CA)

( * ) Notice: Subject to any disclaimer, the term of this patent is extended or adjusted under 35 U.S.C. 154(b) by 0 days.

This patent is subject to a terminal disclaimer.

(21) Appl. No.: 19/187,886

(22) Filed: Apr. 23, 2025

(65) Prior Publication Data

US 2025/0248461 A1 Aug. 7, 2025

Related U.S. Application Data

(63) Continuation of application No. 18/518,565, filed on Nov. 23, 2023, now Pat. No. 12,310,428.

(51) Int. Cl.
*A41C 3/00* (2006.01)

(52) U.S. Cl.
CPC ..... *A41C 3/0028* (2013.01); *A41C 3/0071* (2013.01)

(58) Field of Classification Search
CPC ..... A41C 3/0071; A41C 3/0028
See application file for complete search history.

(56) References Cited

U.S. PATENT DOCUMENTS

| | | | | |
|---|---|---|---|---|
| 3,701,168 | A | 10/1972 | Balow | |
| 4,187,855 | A | 2/1980 | Paulus et al. | |
| 4,637,398 | A | 1/1987 | Sherwood | |
| 6,234,867 | B1 | 5/2001 | Fanelli | |
| 6,550,067 | B2 | 4/2003 | Force | |
| 6,659,841 | B2 | 12/2003 | Raimondo | |
| 6,854,132 | B1 | 2/2005 | Polzin | |
| 12,310,428 | B1 * | 5/2025 | Waters | A41C 3/0028 |
| 2004/0016039 | A1 | 1/2004 | Caprio | |
| 2005/0085160 | A1 | 4/2005 | Johnstone | |
| 2005/0164602 | A1 | 7/2005 | Armstrong et al. | |
| 2010/0058512 | A1 | 3/2010 | Rothman | |
| 2011/0124267 | A1 | 5/2011 | Op'T Hof | |
| 2011/0275277 | A1 | 11/2011 | Martins-Crawbuck | |
| 2012/0220192 | A1 | 8/2012 | Swendseid | |
| 2013/0171911 | A1 | 7/2013 | Swendseid | |
| 2014/0087625 | A1 | 3/2014 | Ironi | |
| 2016/0021940 | A1 | 1/2016 | Carney | |
| 2016/0037830 | A1 | 2/2016 | Swendseid | |

(Continued)

*Primary Examiner* — Gloria M Hale

(57) ABSTRACT

Provided herein is a breast support garment having a front portion connected to a back portion and a pair of straps extending therebetween. The front portion includes an inner liner, a middle layer connected to the inner liner along a bottom edge, a portion of first and second side edges, and a portion of an upper edge, at least one pocket cavity between the inner liner and the middle layer, with a pocket entrance opening along an unattached edge of the middle layer, an outer layer with first and second wrapping wings, each with proximal ends connected to sides of the garment and distal ends, and an adjustable fastener having a first part couple to the distal ends of each of the wrapping wings, and a second part coupled to the front portion. Positions of each wrapping wing are adjusted by adjusting a fastening position of the fastener.

19 Claims, 7 Drawing Sheets

(56) References Cited

U.S. PATENT DOCUMENTS

| | | | |
|---|---|---|---|
| 2016/0081398 | A1 | 3/2016 | Tempesta |
| 2016/0081399 | A1 | 3/2016 | Tempesta |
| 2017/0202273 | A1 | 7/2017 | Tempesta |
| 2017/0265528 | A1 | 9/2017 | Tempesta |
| 2017/0265529 | A1 | 9/2017 | Tempesta |
| 2017/0296359 | A1 | 10/2017 | Conway |
| 2018/0064178 | A1 | 3/2018 | Akerson et al. |
| 2018/0160743 | A1 | 6/2018 | Tempesta |
| 2020/0297042 | A1 | 9/2020 | Carlino et al. |
| 2022/0202107 | A1 | 6/2022 | Wong |
| 2022/0338561 | A1 | 10/2022 | Royal |

* cited by examiner

BREAST SUPPORT GARMENT

FIELD OF INVENTION

This invention relates to breast support garments, and more particularly, to breast support garments with pocket cavities and adjustable support.

BACKGROUND OF THE INVENTION

Typical breast support garments are designed to provide support to breast tissue by restricting the movement of breast tissue. For example, typical garments are designed to restrict the movement of breast tissue by uniformly compressing the breast tissue to the wearer's chest. In order to improve the fit of the garment or increase or decrease support provided by the garment, these garments are usually adjustable by adjusting the length of the shoulder straps or the size of the torso opening, thereby increasing the compression of the garment against the body of the wearer.

However, following various breast surgeries, such as a single- or double-mastectomy, a lumpectomy or a breast augmentation, a wearer of a breast support garment has additional support and adjustment needs that makes wearing typical breast support garments unsuitable. Furthermore, the wearer will also need a garment that is comfortable against the body and any surgical scars, and provides a natural appearance. To meet these needs, breast support garments have been designed to hold prosthetic(s) in place in order to provide a natural appearance to the wearer while also being comfortable to the wearer. For example, previous breast support garments have pockets for holding one or two prosthetic devices in the garment itself without needing a separate garment.

However, there remains a need for breast support garments that provide a natural appearance and have improved adjustability to provide support and comfort to the wearer.

SUMMARY OF THE INVENTION

In various embodiments, the present disclosure provides breast support garments that are adjustable to provide comfort and support to a wearer, particularly a wearer who has undergone a breast surgery.

In one aspect, the present disclosure provides a breast support garment, the breast support garment comprising a front portion for covering at least a portion of a chest area of a wearer and extending from a first side of the breast support garment to a second side of the breast support garment; a back portion for covering a portion of a back area of the wearer, the back portion being connected to the front portion at the first side and the second side, and the front portion and the back portion forming a torso opening; a pair of straps spaced apart one from another and connected to and extending between the front portion and the back portion, each of the pair of straps having a first end connected to an upper side of the front portion, the front portion including: an inner liner having a first face and an opposite second face, a bottom edge and an upper edge; a middle layer having a first face facing the second face of the inner liner and an opposite second face, the middle layer connected to the inner liner along at least a bottom edge, at least a portion of a first side edge, at least a portion of a second side edge and at least a portion of an upper edge of the middle layer; at least one pocket cavity formed between the inner liner and the middle layer, with a pocket entrance opening formed along an unattached edge of the middle layer; an outer layer including an outer face forming at least a portion of an outer face of the breast support garment and an opposite inner face, the outer layer having a first wrapping wing having a proximal end connected to the inner liner at the first side of the garment and a distal end, and a second wrapping wing having a proximal end connected to the inner liner at the second side of the garment and a distal end; and an adjustable two-part fastener having a first part coupled to the distal end of each of the first wrapping wing and the second wrapping wing and a second part coupled to a portion of a bottom side of the front portion of the breast support garment, wherein a position of each of the first wrapping wing and the second wrapping wing is adjusted by adjusting a fastening position of the adjustable two-part fastener, thereby adjusting a support level and a fit of the breast support garment.

In various embodiments, the the middle layer is further connected to the inner liner along a vertical central line across the front portion forming a first pocket with a first entrance opening and a second pocket with a second entrance opening. For example, the breast support garment may comprise a central adhesive positioned along the vertical central line across the front portion and between the inner liner and the middle layer to divide the at least one pocket cavity into the first and second pockets. The central adhesive may further comprise first and second base arms that extend from the central vertical line toward the first and second sides, respectively, of the breast support garment.

In various embodiments, the first entrance opening is along a portion of a first arm opening edge and the second entrance opening is along a portion of a second arm opening edge, and the first entrance opening is concealed by the first wrapping wing and the second entrance opening is concealed by the second wrapping wing.

In various embodiments, the pocket cavity is sized to fit a breast support cup or breast prostheses.

In various embodiments, the first pocket and the second pocket are each sized to fit a breast support cup or breast prostheses.

In various embodiments, the middle layer is connected to the inner liner along an entire length of the upper edge of the middle layer.

In various embodiments, the second part of the adjustable two-part fastener is coupled to a bottom side of the middle layer.

In various embodiments, the breast support garment further comprises a bottom under-band connected to the front portion and the back portion.

In various embodiments, the bottom under-band is connected to the second face of the middle layer.

In various embodiments, the second part of the adjustable two-part fastener is coupled to the bottom under-band.

In various embodiments, the breast support garment further comprises first and second side stabilizers adjacent to the first and second sides, respectively, of the breast support garment and positioned between the inner liner and the middle layer. For example, the first and second side stabilizers may comprise an adhesive, a mesh, a fabric or a foam.

In various embodiments, the proximal edge of the outer layer is positioned over the inner liner and connected to the first face of the inner liner.

In various embodiments, first and second side edges of the inner liner extend beyond the first and second side edges of the middle layer such that a connection between the inner liner and the back portion is set back from a connection between the middle layer and/or the outer layer with the back portion.

In various embodiments, the connections between the front portion and the back portion at the first side and the second side comprise a seam or are seamless.

In various embodiments, the adjustable two-part fastener is a swan hook fastener, a hook and loop fastener, a hook and eye fastener, a button and loop fastener, a clasp and hook fastener, or a buckle.

In various embodiments, the back portion of the breast support garment further comprises an opening with a back portion adjustable two-part fastener to close and open the opening. For example, the back portion adjustable two-part fastener may be a swan hook fastener, a hook and loop fastener, a hook and eye fastener, a button and loop fastener, a clasp and hook fastener, or a buckle.

In various embodiments, the breast support garment is a mastectomy bra, a bra, a swimsuit or a tank top.

In addition to the aspects and embodiments describe above, further aspects and embodiments will become apparent by reference to the drawings.

BRIEF DESCRIPTION OF THE DRAWINGS

Throughout the drawings, reference numbers may be re-used to indicate correspondence between referenced elements. The drawings are provided to illustrate example embodiments described herein and are not intended to limit the scope of the disclosure. Sizes and relative positions of elements in the drawings are not necessarily drawn to scale. For example, the shapes of various elements and angles are not drawn to scale, and some of these elements are arbitrarily enlarged and positioned to improve drawing legibility.

DETAILED DESCRIPTION

Figure 1:
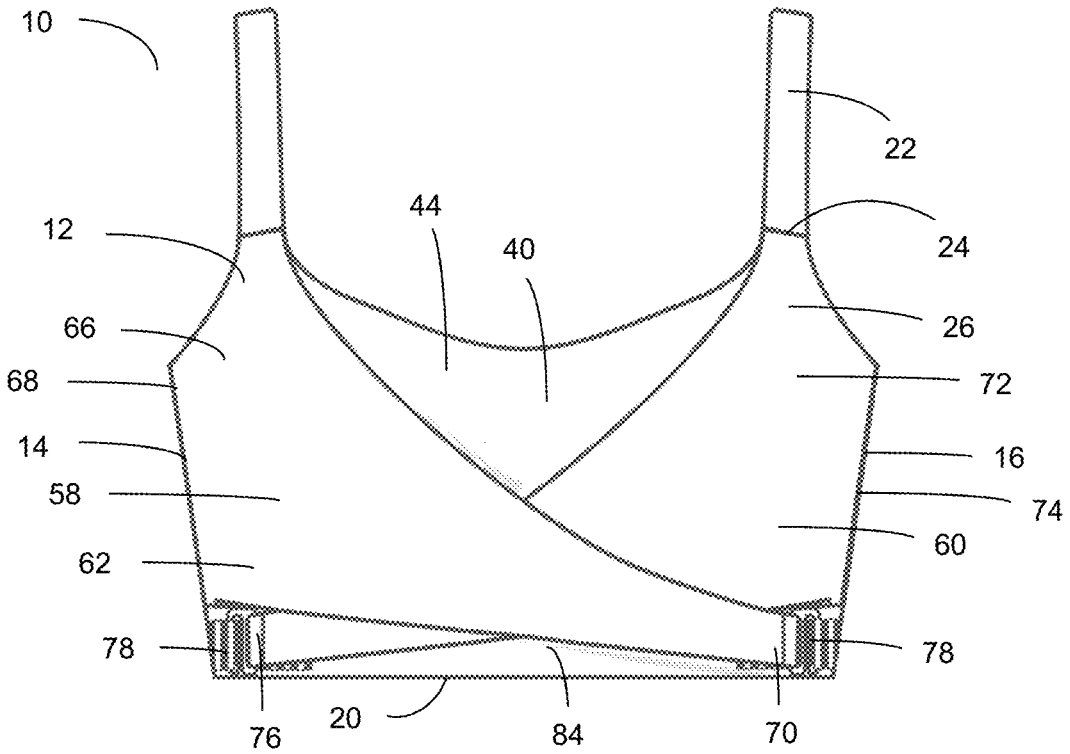
FIG. 1 is a front view of an outer face of an outer layer of a front portion of a breast support garment according to an embodiment of the disclosure.

In the following description, details are set forth to provide an understanding of the application. In some instances, certain structures, techniques, and methods have not been described or shown in detail in order not to obscure the application.

In the context of the present disclosure, various terms are used in accordance with what is understood to be the ordinary meaning of those terms.

Directional terms such as "top", "bottom", "front", "back", "upper", "lower", "outer" and "inner" are used in the following description for the purpose of providing relative reference only, and are not intended to suggest any limitations on how any article or garment is to be positioned during use, or to be mounted in an assembly or relative to an environment. The use of the word "a" or "an" when used herein in conjunction with the term "comprising" may mean "one", but it is also consistent with the meaning of "one or more", "at least one" and "one or more than one". Any element expressed in the singular form also encompasses its plural form. Any element expressed in the plural form also encompasses its singular form. The term "plurality" as used herein means more than one, for example, two or more, three or more, four or more, and the like.

The present disclosure provides breast support garments. The breast support garments have adjustable support which can be adjusted from the front of the garment, as well as one or more pocket cavities for containing, for example, a prostheses. The breast support garments as provided herein have increased comfort and improved aesthetics for the wearer compared to previous breast support garments.

Referring to FIGS. 1-9, and according to a first embodiment of the disclosure, a breast support garment 10 is shown. The breast support garment 10 comprises a front portion 12 for covering at least a portion of a chest area of a wearer and extending from a first side 14 of the breast support garment 10 to a second side 16 of the breast support garment 10, a back portion 18 for covering a portion of a back area of the wearer, the back portion 18 being connected to the front portion 12 at the first side 14 and the second side 16, and the front portion 12 and the back portion 18 forming a torso opening 20, and a pair of straps 22 spaced apart one from another and connected to and extending between the front portion 12 and the back portion 18, each of the pair of straps 22 having a first end 24 connected to an upper side 26 of the front portion 12. In various embodiments, a length of each of the pair of straps 22 is adjustable.

Figure 7:
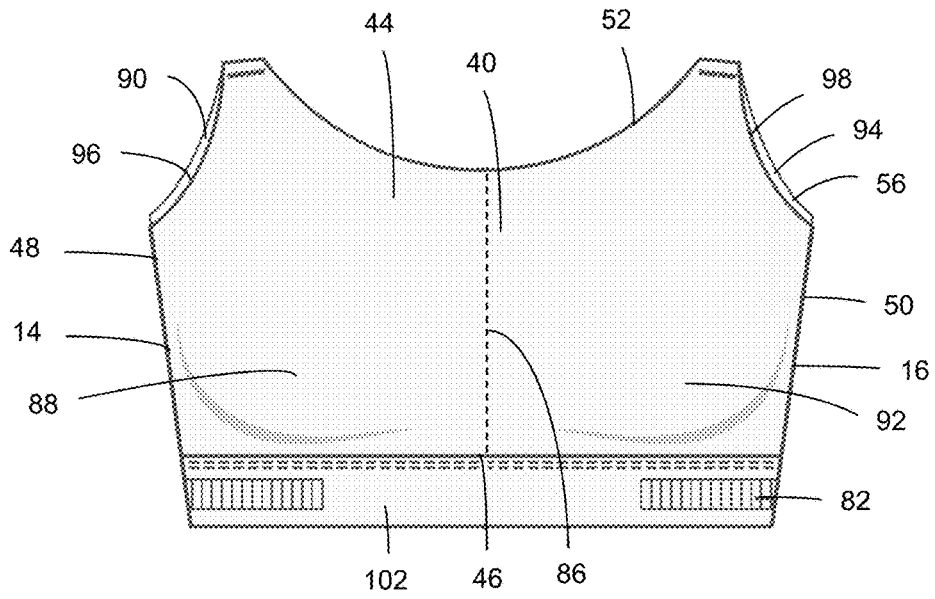
FIG. 7 is a front view of a second face of a middle layer of a breast support garment according to an embodiment of the disclosure.
Figure 8:
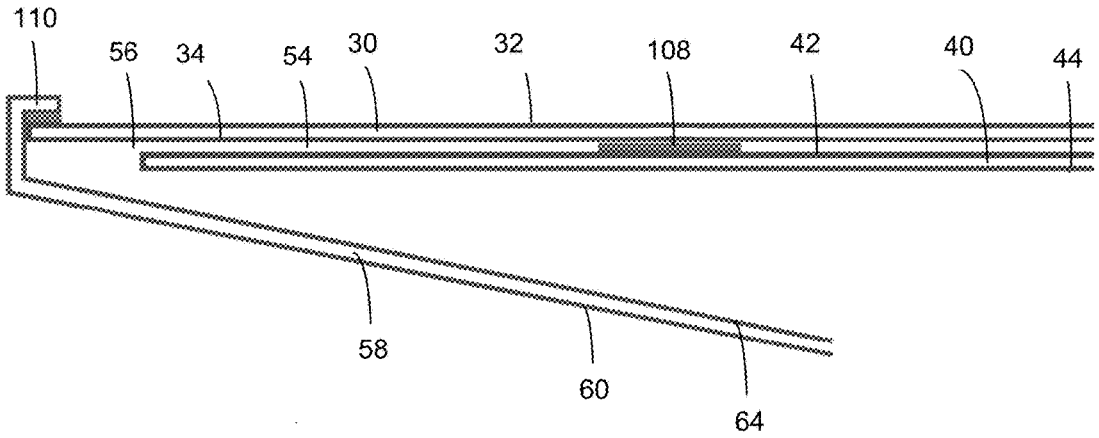
FIG. 8 is a top cross-sectional view of a breast support garment according to an embodiment of the disclosure.
Figure 9:
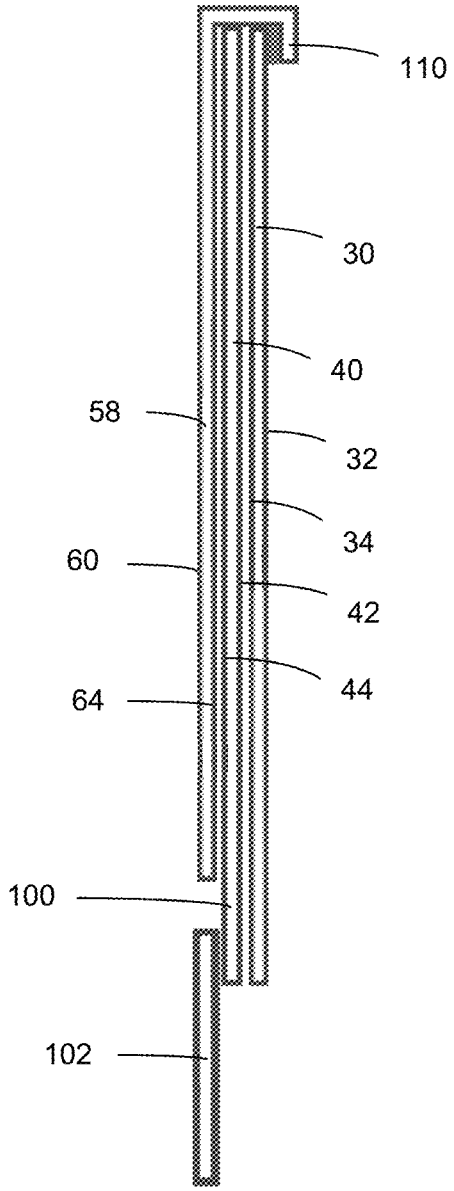
FIG. 9 is a side cross-sectional view of a breast support garment according to an embodiment of the disclosure.

In various embodiments, and as shown in FIGS. 7, 8 and 9, the front portion 12 comprises an inner liner 30 having a first face 32, which faces a body of the wearer, and an opposite second face 34, a bottom edge 36 and an upper edge 38, a middle layer 40 having a first face 42 facing the second face 34 of the inner liner 30 and an opposite second face 44, the middle layer 40 connected to the inner liner 30 along at least a bottom edge 46, at least a portion of a first side edge 48, at least a portion of a second side edge 50 and at least a portion of an upper edge 52 of the middle layer 40, at least one pocket cavity 54 formed between the inner liner 30 and the middle layer 40, with a pocket entrance opening 56 formed along an unattached edge of the middle layer 40, and an outer layer 58 including an outer face 60 forming at least a portion of an outer face 62 of the breast support garment 10 and an opposite inner face 64, the outer layer 58 having a first wrapping wing 66 having a proximal end 68 connected to the inner liner 30 at the first side 14 of the garment 10 and a distal end 70, and a second wrapping wing 72 having a proximal end 74 connected to the inner liner 30 at the second side 16 of the garment 10 and a distal end 76.

Figure 2:
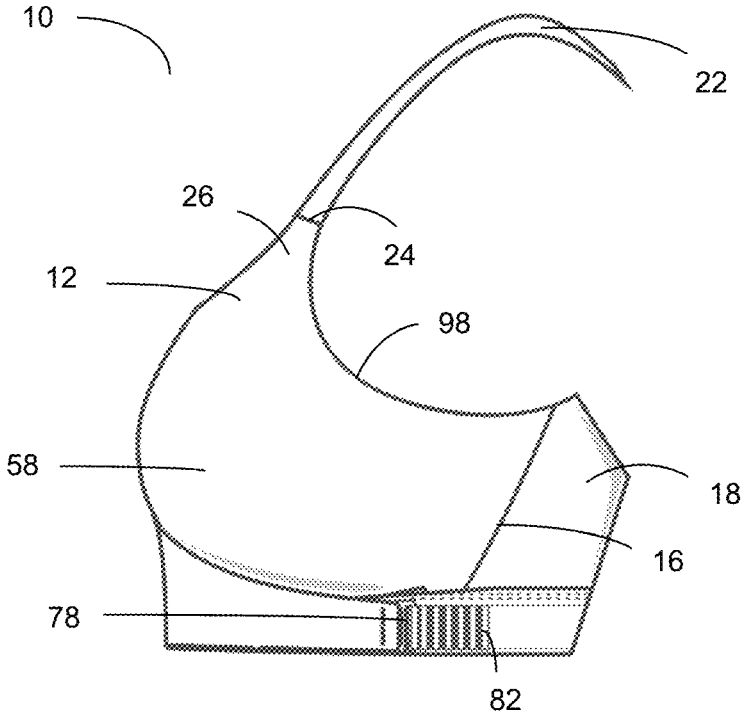
FIG. 2 is a side view of an outer face of an outer layer of a front portion and a back portion of a breast support garment according to an embodiment of the disclosure.

The front portion 12 also includes an adjustable two-part fastener 78 having a first part 80 coupled to the distal ends 70 and 76 of each of the first wrapping wing 66 and the second wrapping wing 72, and a second part 82 coupled to a portion of a bottom side 84 of the front portion 12 of the breast support garment 10 at one or more positions of the front portion 12. For example, and as shown in FIG. 1, the breast support garment 10 may have two positions for the second part 82 of the two-part fastener 78. The support provided by each of the first wrapping wing 66 and the second wrapping wing 72 is adjusted by adjusting a fastening position of the adjustable two-part fastener 78, thereby adjusting a support level and a fit of the breast support garment 10. In various embodiments, the second part 82 of the adjustable two-part fastener 78 may be coupled to a bottom side 100 of the middle layer 40. Positioning the first part 80 in a position on the second part 82 closer to a center of the breast support garment 10 will provide a looser fit, while positioning the first part 80 in a position closer to either the first side 14 or the second side 16 of the breast support garment 10 will provide a tighter fit, as shown in FIG. 2. Each of the first wrapping wing 66 and the second wrapping wing 72 is adjusted independently one from the other, such as, for example, the first part 80 coupled to the distal end 70 of the first wrapping wing 66 can be coupled to the second part 82 closer to the center of the breast support garment 10 for a looser fit or to fit a bigger-sized breast, while the first part 80 coupled to the distal end 76 of the second wrapping wing 72 can be coupled to the second part 82 closer to the first side 14 of the breast support garment 10 for a tighter fit or to fit a smaller-sized breast, or vice versa.

When worn by the wearer, the first wrapping wing 66 extends across the middle layer 40 and then the second wrapping wing 72 also extends across the middle layer 40 in order to couple each of the first parts 80 to the second parts 82 of the adjustable two-part fastener 78. As shown in FIG. 1, the first wrapping wing 66 extends over the second wrapping wing 72 to form a cross-over and layered structure, which provides support to the breast tissue of the wearer. Alternatively, the second wrapping wing 72 can extend over the first wrapping wing 66 to form a cross-over and layered structure. The shape of the first wrapping wing 66 and the second wrapping wing 72 may have a triangular shape as shown in FIG. 1, such that the outer layer 58 does not cover the entirety of the middle layer 40. Alternatively, the first wrapping wing 66 and the second wrapping wing 72 may be shaped such that the entirety of the middle layer 40 is covered.

In various embodiments, the adjustable two-part fastener 78 is a swan hook fastener, a hook and loop fastener (such as, for example, VELCRO®), a hook and eye fastener, a button and loop fastener, a clasp and hook fastener or a buckle. Thus, when the breast support garment 10 is worn by the wearer, the wearer may adjust the support and fit of the breast support garment 10 by closing and/or adjusting the adjustable two-part fastener 78. For example, and as shown in FIGS. 1, 2, 7 and 10, there may be multiple positions of the second part 82 of the adjustable two-part fastener into which the first part 80 may be positioned. The positions of the second part 82 may be positioned laterally along the bottom side 84 of the front portion 12. By positioning the first part 80 in the different positions of the second part 82, the wearer may adjust the fit and support provided by the breast support garment 10.

In various embodiments, the at least one pocket cavity 54 is configured and sized to contain and hold an insert, such as a breast support cup or a breast prostheses. By being held between the inner liner 30 and the middle layer 40, the insert or breast prostheses is easily accessible to the wearer as the pocket entrance opening 56 is located on the front portion 12 of the breast support garment 10, and holds the prostheses in place so that is fits comfortably, accurately and is less likely to shift in position or fall away from the body of the wearer during use, and is away from the wearer's skin to avoid any chaffing or skin irritation. The at least one pocket cavity 54 may be one pocket cavity 54, with one or more pocket entrance openings 56. Alternatively, and in order to define two pocket cavities 54, the middle layer 40 may be further connected to the inner liner 30 along a vertical central line 86 across the front portion 12, thereby forming a first pocket 88 with a first entrance opening 90 and a second pocket 92 with a second entrance opening 94, as shown in FIG. 7. For example, an adhesive 108 (for example, an adhesive tape) can be added along the vertical central line 86 to connect the inner liner 30 and the middle layer 40 to form the first and second pockets, 88 and 92, respectively.

With respect to the pocket entrance openings, the first entrance opening 90 may be along a portion of a first arm opening edge 96 and the second entrance opening 94 may be along a portion of a second arm opening edge 98. When worn by the wearer, the first entrance opening 90 and the second entrance opening 94 may be concealed by the first wrapping wing 66 and the second wrapping wing 72, respectively. Thus, the first wrapping wing 66 and the second wrapping wing 72 may act to conceal the at least one pocket cavity 54, to improve the aesthetic of the breast support garment 10 and prevent the insert being displaced from the at least one pocket cavity 54 and/or prevent movement of the insert within the at least one pocket cavity 54 when worn by the wearer and/or during activity. Alternatively or in addition, the pocket entrance opening 56 may be between at least a portion of the upper edge 38 of the inner liner 30 and the upper edge 52 of the middle payer 40, along a portion of the first side 14 between the inner liner 30 and the middle layer 40, and/or along a portion of the second side 16 between the inner liner 30 and the middle layer 40 of the breast support garment 10.

In various embodiments, a flap (not shown) may be connected to the inner liner 30 in proximity to the pocket entrance opening 56 in order to cover the pocket entrance opening 56. The wearer can close or cover the pocket entrance opening 56 by positioning an unattached side of the flap over the pocket entrance opening 56 and can uncover the pocket entrance opening 56 by moving the unattached side of the flap away.

In various embodiments, the middle layer 40 is connected to the inner liner 30 along at least the bottom edge 46, at least a portion of the first side edge 48, at least a portion of the second side edge 50 and at least the portion of an upper edge 52 of the middle layer 40. For example, in embodiments where the breast support garment 10 comprises the first entrance opening 90 and the second entrance opening 94 along a portion of the first and second arm opening edges 96 and 98, respectively, the middle layer 40 may be connected to the inner liner 30 along the bottom edge 46, the first side edge 48, the second side edge 50 and an entire length of the upper edge 52 of the middle layer 40. In embodiments where the breast support garment comprises the pocket entrance opening along the upper edge 52 of the middle layer 40, the middle layer 40 may be connected to the inner liner 30 along the bottom edge 46, the first side edge 48, the second side edge 50, a portion of the upper edge 52, the first arm opening edge 96 and the second arm opening edge 98. In embodiments wherein the breast support garment comprises the pocket entrance opening 56 along the first side 14 and/or the second side 16 of the breast support garment 10, the middle layer 40 may be connected to the inner liner 30 along the bottom edge 46, the upper edge 52, the first arm opening edge 96 and the second arm opening edge 98. The middle layer 40 may also be connected to the inner liner at the first side 14 if the pocket entrance opening 56 is at the second side 16 of the breast support garment 10, or connected at the second side 16 if the pocket entrance opening 56 is at the first side 14 of the breast support garment 10.

In various embodiments, and as shown in FIG. 9, the breast support garment 10 may further comprise a bottom under-band 102 connected to the front portion 12 and the back portion 18. For example, the bottom under-band 102 may be connected to the bottom side 100 of the middle layer 40. For example, the bottom under-band 102 may be connected to the second face 44 of the middle layer 40. For example, the bottom under-band 102 may be connected to the bottom edge 46 of the middle layer 40. In various embodiments, the second part 82 of the adjustable two-part fastener 78 may be coupled to the bottom under-band 102, as shown in FIG. 7. Alternatively, the under-band of the breast support garment may be incorporated within the front portion 12 and the back portion 18, and is either sewn or bonded into the front portion 12 and the back portion 18. For example, the under-band 102 may be bonded between the inner liner 30 and the middle layer 40 of the front portion 12 and between an inner and outer layer of the back portion 18.

Figure 10:
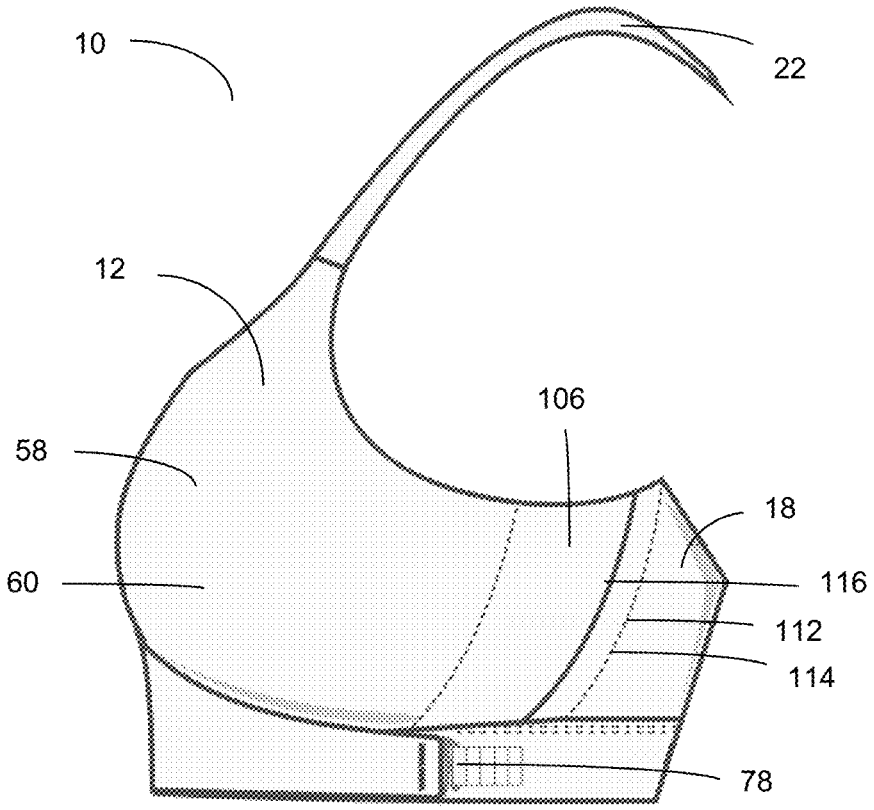
FIG. 10 is a side view of an outer face of an outer layer of a front portion and a back portion of a breast support garment according to a further embodiment of the disclosure.
Figure 11:
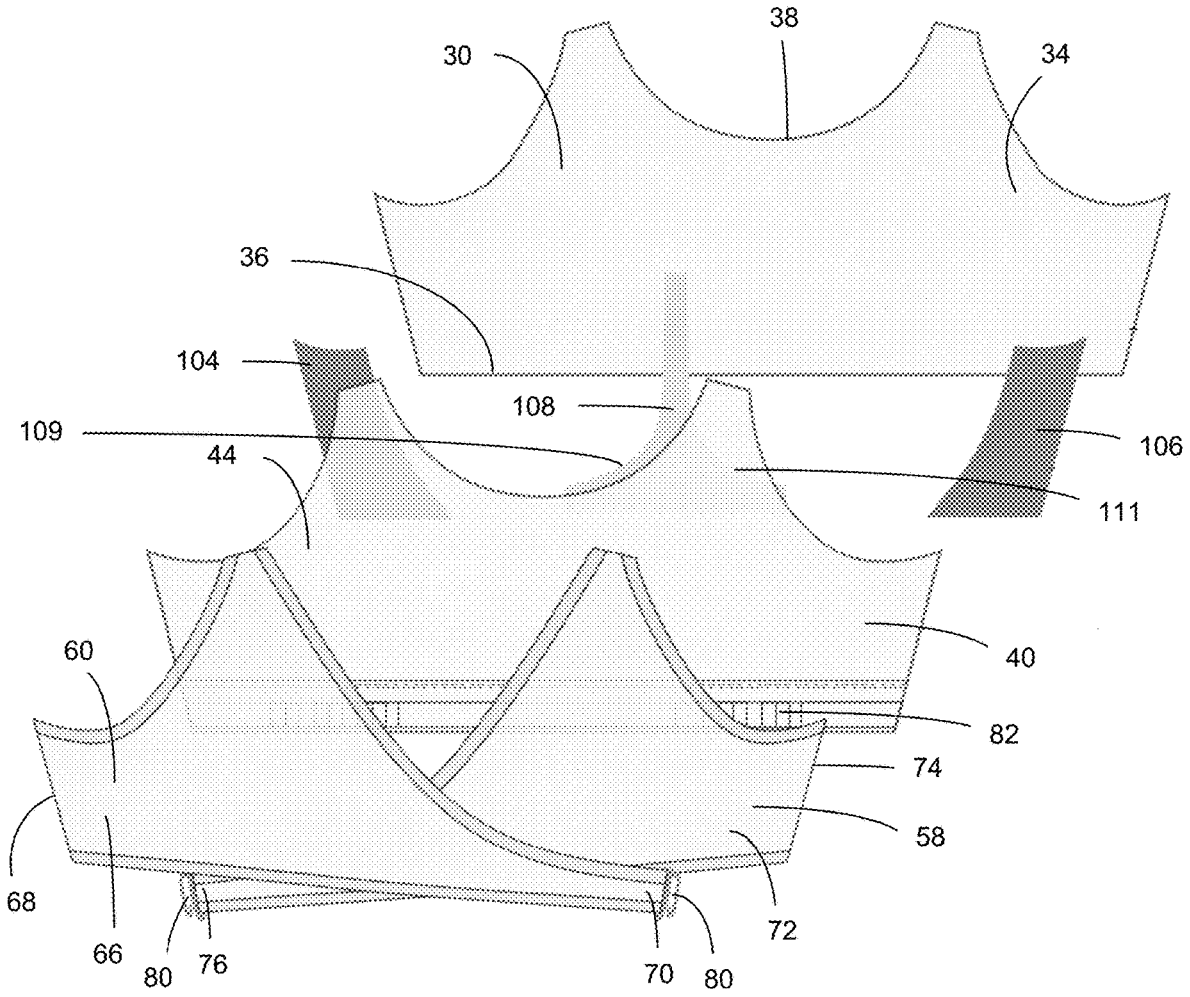
FIG. 11 is an exploded perspective view of a front portion of a breast support garment according to a further embodiment of the disclosure.

In order for the breast support garment 10 to provide additional support to the wearer, the breast support garment may further comprise first and second side stabilizers, 104 and 106, respectively, adjacent to the first and second sides, 14 and 16, respectively, of the breast support garment 10 and positioned between the inner liner 30 and the middle layer 40, as shown in FIGS. 10 and 11. In various embodiments, the first and second side stabilizers, 104 and 106, respectively, may comprise an adhesive, a mesh (such as, for example, a power mesh), a fabric or a foam that would be suitable for providing additional support to the breast support garment 10. In addition, the breast support garment 10 may further comprise a central adhesive 108 along the vertical central line 86 across the front portion 12 and between the inner liner 30 and the middle layer 40, as shown in FIGS. 8 and 11, to divide the at least one pocket cavity 54 into two separate pocket cavities, 88 and 92, as described above. In various embodiments, the central adhesive 108 may further comprise a mesh (such as, for example, a power mesh), a fabric or a foam in addition to the adhesive for providing additional support to the breast support garment 10. The central adhesive 108 may further comprise a first base arm 109 that extends from the central vertical line 86 towards the first side 14 and a second base arm 111 that extends from the central vertical line 86 towards the second side 16, to provide additional support under the breast tissue root for the breast tissue and/or the insert when the breast support garment 10 is worn (FIG. 11).

The front portion 12, the back portion 18, the pair of straps 22, the inner liner 30, the middle layer 40, the outer layer 58 and the bottom under-band 102 may be sewn or bonded together along various seams or edges, or on various other parts, as described above. The parts of the breast support garment may be connected through ultrasonic bonding and/or may also include any suitable elastic finishing. For example, the connections between the front portion 12 and the back portion 18 at the first side 14 of the breast support garment 10 and at the second side 16 of the breast support garment may comprise a seam or be seamless. In various embodiments, and as shown in FIGS. 8 and 9, a proximal edge 110 of the outer layer 58 is positioned over the inner liner 30 and connected to the first face 32 of the inner liner 30.

As shown in FIG. 10, first and second side edges 112 of the inner liner 30 may extend beyond the first and second side edges 48 and 50, respectively, of the middle layer 40 such that a connection 114 between the inner liner 30 and the back portion 18 is set back from a connection 116 between the middle layer 40 and/or the outer layer 58 with the back portion 18. This embodiment may increase the comfort of the garment to the wearer by decreasing "rubbing" of the seam against the body of the wearer, and/or to avoid having a seam of the breast support garment 10 positioned over any scar tissue the wearer may have as a result of a breast surgery.

Figure 3:
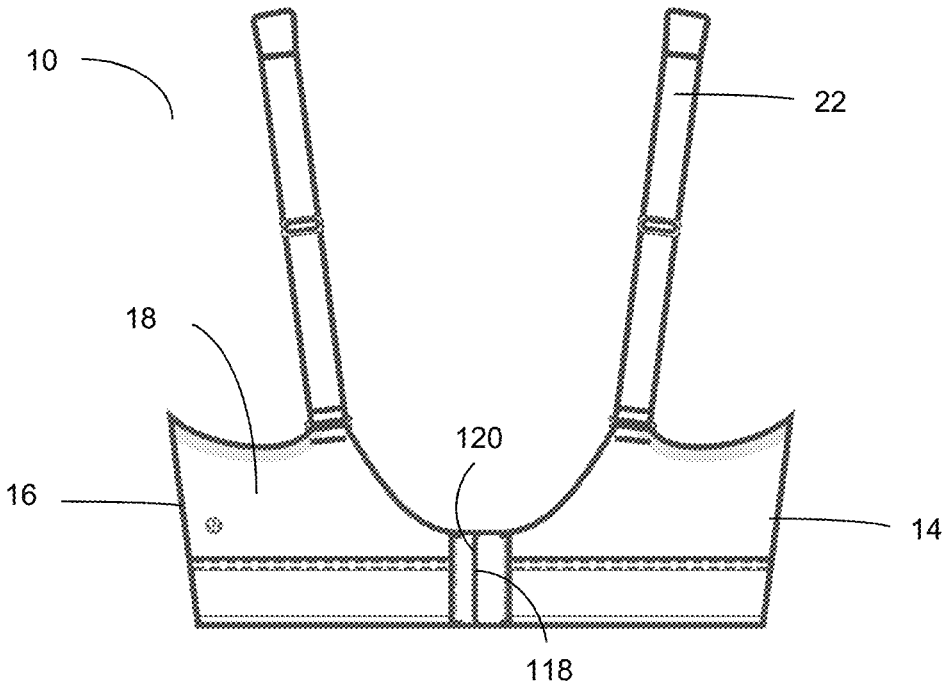
FIG. 3 is a back view of a back portion of a breast support garment according to an embodiment of the disclosure.
Figure 4:
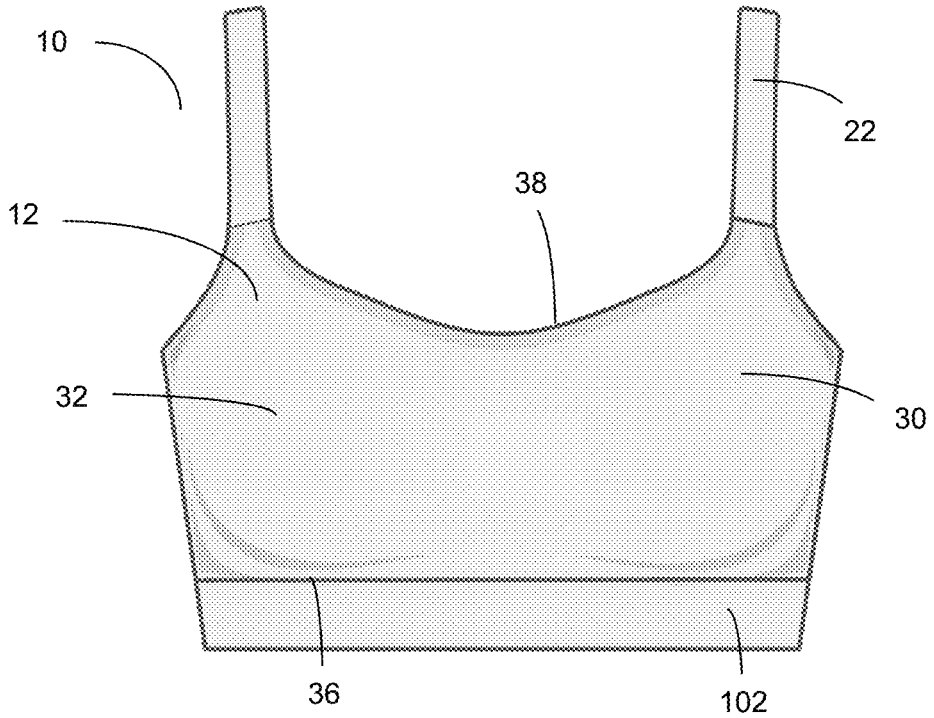
FIG. 4 is a front view of a first face of an inner liner of a front portion of a breast support garment according to an embodiment of the disclosure.
Figure 5:
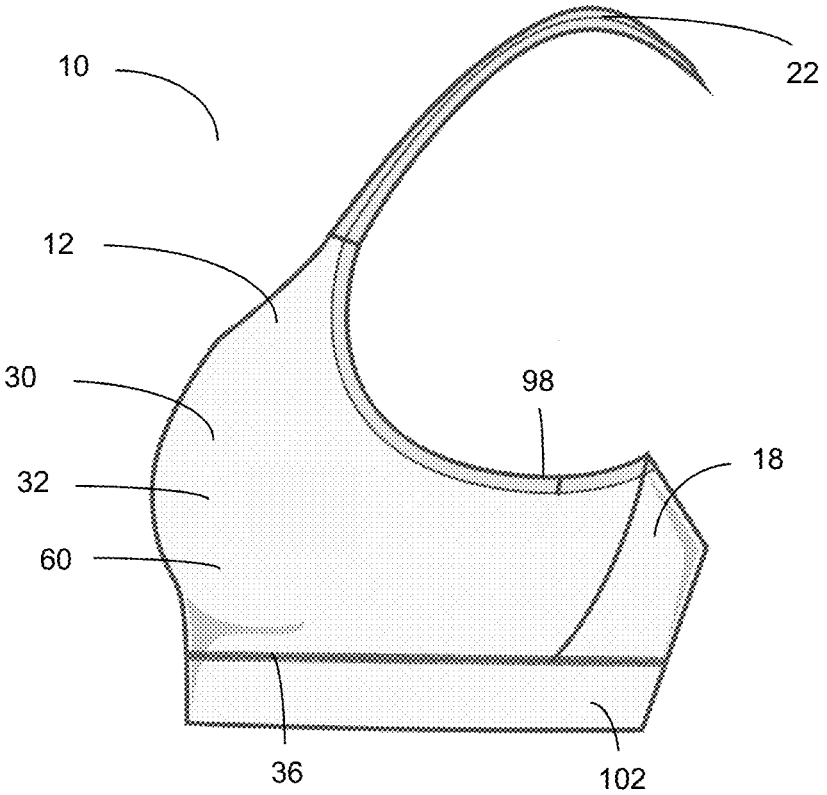
FIG. 5 is a side view of a first face of an inner liner of a front portion and a back portion of a breast support garment according to an embodiment of the disclosure.
Figure 6:
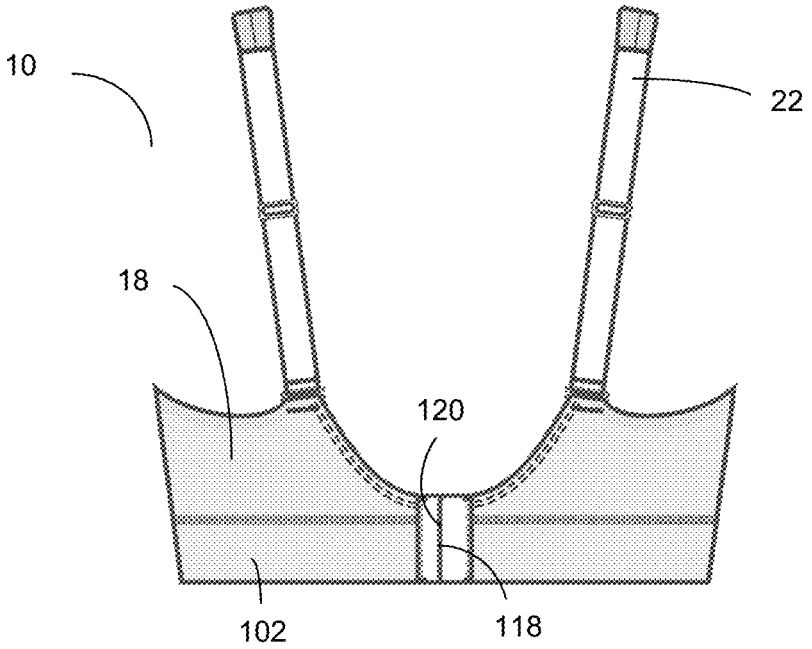
FIG. 6 is an inside view of a back portion of a breast support garment according to an embodiment of the disclosure.

In various embodiments, the back portion 18 may comprise an opening 118 with a back portion adjustable two-part fastener 120 to close and open the opening 118, as shown in FIGS. 3 and 6. In various embodiments, the back portion adjustable two-part fastener 120 provides another feature on the breast support garment 10 by which the user can adjust the fit and support provided by the breast support garment 10. In various embodiments, the back portion adjustable two-part fastener 120 is a swan hook fastener, a hook and loop fastener (such as, for example, VELCRO®), a hook and eye fastener, a button and loop fastener, a clasp and hook fastener or a buckle.

The breast support garment 10 may be any garment that covers at least a portion of the chest area and at least a portion of the back area of the wearer. For example, the breast support garment 10 may be a mastectomy bra, a bra, a swimsuit or a tank top.

While particular elements, embodiments and applications of the present application have been shown and described, it will be understood, that the scope of the application is not limited thereto, since modifications can be made by those skilled in the art without departing from the scope of the present application, particularly in light of the foregoing teachings. Thus, for example, in any method or process disclosed herein, the acts or operations making up the method/process may be performed in any suitable sequence and are not necessarily limited to any particular disclosed sequence. Elements and components can be configured or arranged differently, combined, and/or eliminated in various embodiments. The various features and processes described above may be used independently of one another, or may be combined in various ways. All possible combinations and subcombinations are intended to fall within the scope of this application. Reference throughout this disclosure to "some embodiments," "an embodiment," or the like, means that a particular feature, structure, step, process, or characteristic described in connection with the embodiment is included in at least one embodiment. Thus, appearances of the phrases "in some embodiments," "in an embodiment," or the like, throughout this disclosure are not necessarily all referring to the same embodiment and may refer to one or more of the same or different embodiments. Indeed, the novel methods and systems described herein may be embodied in a variety of other forms; furthermore, various omissions, additions, substitutions, equivalents, rearrangements, and changes in the form of the embodiments described herein may be made without departing from the spirit of the application.

Various aspects and advantages of the embodiments have been described where appropriate. It is to be understood that not necessarily all such aspects or advantages may be achieved in accordance with any particular embodiment. Thus, for example, it should be recognized that the various embodiments may be carried out in a manner that achieves or optimizes one advantage or group of advantages as taught herein without necessarily achieving other aspects or advantages as may be taught or suggested herein.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without operator input or prompting, whether these features, elements and/or steps are included or are to be performed in any particular embodiment. No single feature or group of features is required for or indispensable to any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

The example calculations, simulations, results, graphs, values, and parameters of the embodiments described herein are intended to illustrate and not to limit the disclosed embodiments. Other embodiments can be configured and/or operated differently than the illustrative examples described herein.

What is claimed is:

1. A breast support garment, comprising:

a front portion for covering at least a portion of a chest area of a wearer and extending from a first side of the breast support garment to a second side of the breast support garment;

a back portion for covering a portion of a back area of the wearer, the back portion being connected to the front portion at the first side and the second side, and the front portion and the back portion forming a torso opening;

a pair of straps spaced apart one from another and connected to and extending between the front portion and the back portion, each of the pair of straps having a first end connected to an upper side of the front portion, the front portion including:

an inner liner having a first face and an opposite second face, a bottom edge and an upper edge;

an outer layer including an outer face forming at least a portion of an outer face of the breast support garment and an opposite inner face, the outer layer having a first wrapping wing having a proximal end connected to the inner liner at the first side of the garment and a distal end, and a second wrapping wing having a proximal end connected to the inner liner at the second side of the garment and a distal end; and an adjustable two-part fastener having a first part coupled to the distal end of each of the first wrapping wing and the second wrapping wing and a second part coupled to a portion of a bottom side of the front portion of the breast support garment, wherein a position of each of the first wrapping wing and the second wrapping wing is adjusted by adjusting a fastening position of the adjustable two-part fastener, thereby adjusting a support level and a fit of the breast support garment.

2. The breast support garment of claim 1, wherein the front portion further comprises a middle layer having a first face facing the second face of the inner liner and an opposite second face, the middle layer connected to the inner liner along at least a bottom edge, at least a portion of a first side edge, at least a portion of second side edge and at least a portion of an upper edge of the middle layer, at least one pocket cavity formed between the inner liner and the middle layer, with a pocket entrance opening formed along an unattached edge of the middle layer.

3. The breast support garment of claim 2, wherein the middle layer is further connected to the inner liner along a vertical central line across the front portion forming a first pocket with a first entrance opening and a second pocket with a second entrance opening.

4. The breast support garment of claim 3, wherein the first entrance opening is along a portion of a first arm opening edge and the second entrance opening is along a portion of a second arm opening edge, and the first entrance opening is concealed by the first wrapping wing and the second entrance opening is concealed by the second wrapping wing.

5. The breast support garment of claim 2, wherein the pocket cavity is sized to fit a breast support cup or breast prostheses.

6. The breast support garment of claim 3, wherein the first pocket and the second pocket are each sized to fit a breast support cup or breast prostheses.

7. The breast support garment of claim 2, wherein the second part of the adjustable two-part fastener is coupled to a bottom side of the middle layer.

8. The breast support garment of claim 1, further comprising a bottom under-band connected to the front portion and the back portion.

9. The breast support garment of claim 8, wherein the second part of the adjustable two-part fastener is coupled to the bottom under-band.

10. The breast support garment of claim 2, further comprising first and second side stabilizers adjacent to the first and second sides, respectively, of the breast support garment and positioned between the inner liner and the middle layer.

11. The breast support garment of claim 10, wherein the first and second side stabilizers comprise an adhesive, a mesh, a fabric or a foam.

12. The breast support garment of claim 3, further comprising a central adhesive positioned along the vertical central line across the front portion and between the inner liner and the middle layer to divide the at least one pocket cavity into the first and second pockets.

13. The breast support garment of claim 12, wherein the central adhesive comprises first and second base arms that extend from the central vertical line toward the first and second sides, respectively, of the breast support garment.

14. The breast support garment of claim 1, wherein the proximal edge of the outer layer is positioned over the inner liner and connected to the first face of the inner liner.

15. The breast support garment of claim 2, wherein first and second side edges of the inner liner extend beyond the first and second side edges of the middle layer such that a connection between the inner liner and the back portion is set back from a connection between the middle layer and/or the outer layer with the back portion.

16. The breast support garment of claim 1, wherein the connections between the front portion and the back portion at the first side and the second side comprise a seam or are seamless.

17. The breast support garment of claim 1, wherein the adjustable two-part fastener is a swan hook fastener, a hook and loop fastener, a hook and eye fastener, a button and loop fastener, a clasp and hook fastener, or a buckle.

18. The breast support garment of claim 1, wherein the back portion further comprises an opening with a back portion adjustable two-part fastener to close and open the opening.

19. The breast support garment of claim 18, wherein the back portion adjustable two-part fastener comprises a hook and loop fastener, a hook and eye fastener, a button and loop fastener, a clasp and hook fastener, or a buckle.

* * * * *